US005577576A

United States Patent [19]

Petzl et al.

[11] Patent Number: 5,577,576

[45] Date of Patent: Nov. 26, 1996

[54] DISENGAGEABLE DESCENDER WITH SELF-LOCKING OF THE ROPE

[75] Inventors: Paul Petzl, Barraux; Jean Marc Hede, La Tronche, both of France

[73] Assignee: Zedel, Cralles, France

[21] Appl. No.: 459,671

[22] Filed: Jun. 2, 1995

[30] Foreign Application Priority Data

Jun. 23, 1994 [FR] France ..... 94 07974

[51] Int. Cl.[6] ..... A63B 29/00

[52] U.S. Cl. ..... 188/65.4; 182/193; 24/134 KB

[58] Field of Search ..... 188/65.1–65.5; 182/5–9, 193; 24/132 WL, 134 R, 134 KB, 115 F

[56] References Cited

U.S. PATENT DOCUMENTS 5,054,577 10/1991 Petzl et al. ..... 182/193
5,076,400 12/1991 Petzl et al. .
5,360,083 11/1994 Hede .

FOREIGN PATENT DOCUMENTS 0132592 2/1985 European Pat. Off. .
0303388 2/1989 European Pat. Off. .
0593369 4/1994 European Pat. Off. .
2422587 11/1979 France .
2451752 10/1980 France .
2554102 5/1985 France .
0398819 11/1990 France ..... 182/5
2044414 10/1980 United Kingdom .

*Primary Examiner*—Robert J. Oberleitner
*Assistant Examiner*—Chris Schwartz
*Attorney, Agent, or Firm*—Watson Cole Stevens Davis, P.L.L.C.

[57] ABSTRACT

The invention relates to a self-locking descender wherein the pulley in the form of a cam is equipped with a drive finger cooperating with a mechanism having a transmission rod movable between an active engagement position with the finger to establish a unidirectional mechanical link between the handle and cam when the handle is actuated to an intermediate unlocking position in the course of the descending movement, and an inactive escape position to break said mechanical link after the intermediate position of the handle has been passed, causing disengagement of the pulley and automatic return of the cam to the locking position due to the action of the tension of the rope. The locking effect of the rope is thus preserved after disengagement, without maintaining a force on the handle.

12 Claims, 15 Drawing Sheets

100

DISENGAGEABLE DESCENDER WITH SELF-LOCKING OF THE ROPE

BACKGROUND of the INVENTION

The invention relates to a self-locking safety descender for descending along a rope, comprising:

a first fixed flange supporting a braking pad and a mobile pulley in the form of a cam, said pulley being mounted with limited rotation on a first articulation spindle between a locking position and an unlocking position, and separated from the pad by a space for passage of the rope, a second retractable flange, separated from the first flange by a transverse gap, and able to occupy a withdrawn position for fitting or removal of the rope, and a closed position, in which the rope is held captive in the space, an actuating handle of the pulley to perform manual unlocking of the rope, and a first spring to return the pulley to the unlocking position when the tension of the rope is lower than a preset threshold.

The document FR-A-2,451,752 refers to a self-locking descender having two possibilities of locking the rope depending on the spatial position of the actuating handle. The pulley is permanently securedly affixed to the handle and comprises for this purpose two angularly staggered bosses which alternately lock the rope against a fixed stud, depending on whether the handle is in a raised position or in a lowered position. Unlocking of the rope takes place in an intermediate position. The locking position is achieved following total release of the handle, resulting in rotation of the pulley due to the action of the tension of the rope and the clamping of the rope by the first boss. The second locking position results from the action of the second boss which clamps the rope against the fixed stud at a different place following maximum lowering of the handle. A permanent actuating force is however required on the handle in said lowered position to maintain this second locking of the rope. A decrease of the manual force on the handle, notably due to tiredness, may move the handle to the intermediate position, with a risk of unlocking the rope, which may jeopardize the safety of the person.

SUMMARY OF THE INVENTION

The object of the invention is to achieve a self-locking descender which is safe and easy to use.

The descender according to the invention is characterized in that the cam is associated to a drive finger cooperating with a mechanism having a transmission lever movable between an active engagement position with the finger to establish a unidirectional mechanical link between the handle and the pulley when the handle is actuated to an intermediate unlocking position in the course of the descending movement, and an inactive escape position to break said mechanical link after said intermediate position of the handle has been passed, causing disengagement of the pulley and automatic return of the cam to the locking position due to the action of the tension of the rope.

The presence of the interruptible mechanical link between the handle and pulley enables the effect of the second boss to be preserved after disengagement, without maintaining a force on the handle.

According to one feature of the invention, the drive finger and transmission part are housed inside a rotary base in the form of an annular drum with an open base adjoined to the first flange, the handle protruding out from said base.

According to a first embodiment, the transmission part is formed by a lever pivotally mounted on a second spindle securedly affixed to the base, and comprising a ramp cooperating with a cylindrical part of the finger movable in the opening, said opening being shaped as a circular sector centered on the first spindle, and having a length corresponding to the angular movement of the pulley between the locking and unlocking positions.

The ramp of the transmission lever cooperates with stop means after passing the intermediate position of the handle, resulting in pivoting of said lever to the inactive unlocking position for disengagement of the pulley.

According to two other embodiments, the transmission part is formed by a rod cooperating with the drive finger to form a toggle with dead point passage near to said intermediate position of the handle.

Each mechanism according to the invention is equipped with resetting means causing the transmission pan to return to the active position to reestablish the mechanical link between the handle and pulley. Resetting may be either manual by actuation of the handle or automatic after disengagement of the pulley.

BRIEF DESCRIPTION OF THE DRAWINGS

Other advantages and features will become more clearly apparent from the following description of several embodiments of the invention, given as non-restrictive examples only and represented in the accompanying drawings, in which.

DETAILED DESCRIPTION OF THE PREFERRED EMBODIMENT

Figure 1:
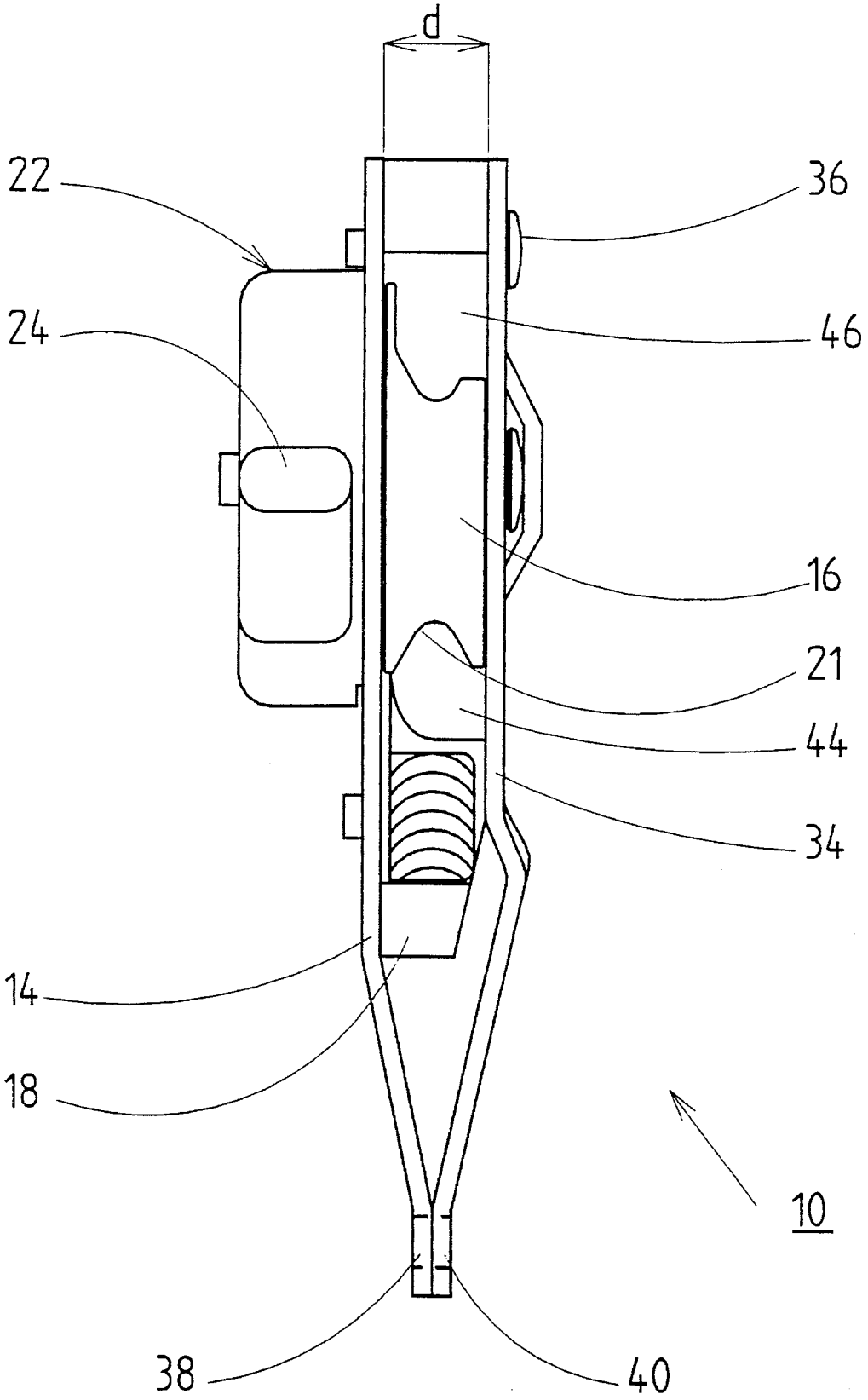
FIG. 1 is a side view of the descender according to the invention.
Figure 2:
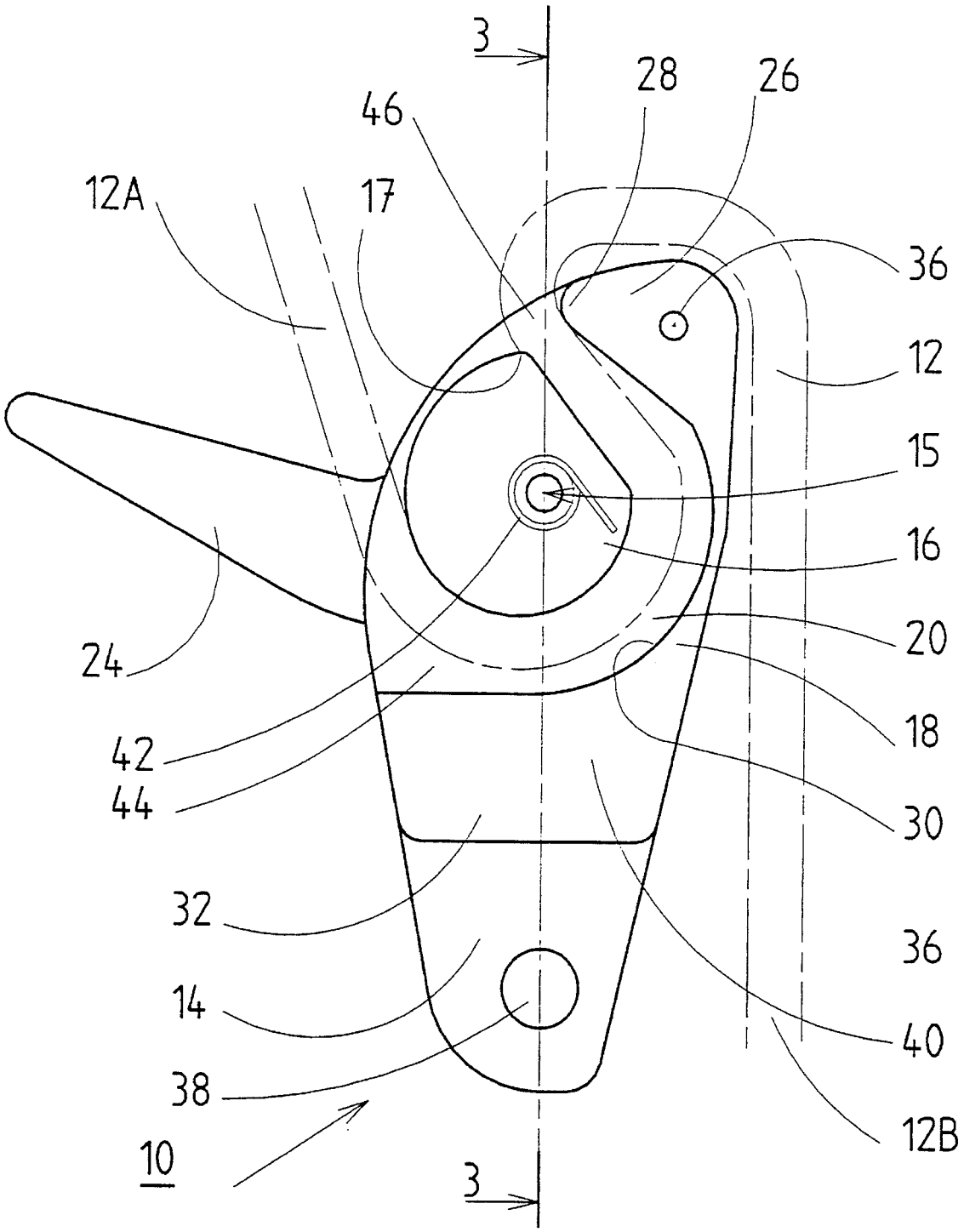
FIG. 2 shows an elevational view of the descender after the second flange has been removed.
Figure 3:
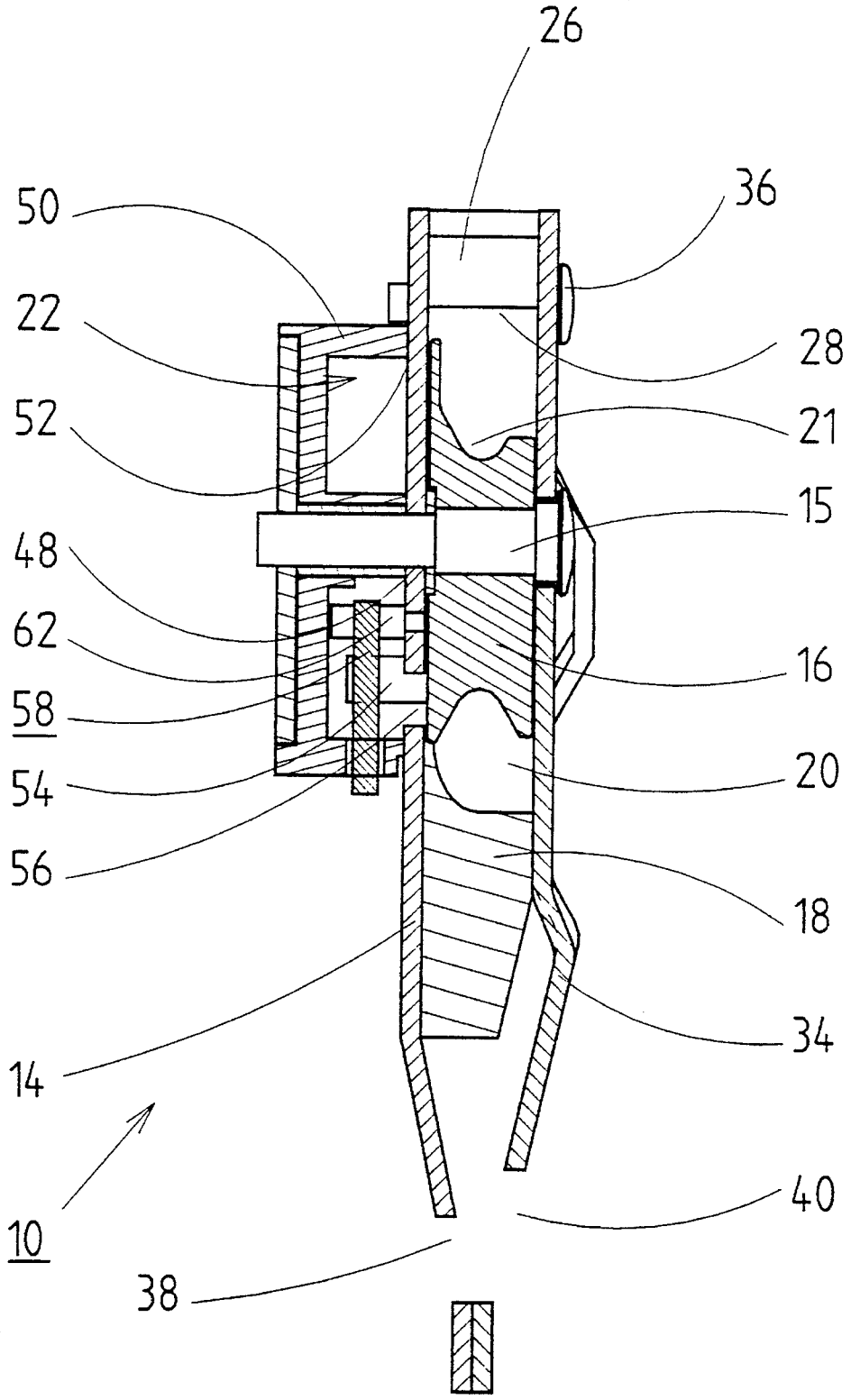
FIG. 3 is a cross-sectional view along the line 3—3 of FIG. 2.

In FIGS. 1 to 7, a safety descender, designated by the general reference 10, is used for controlled descent of a person along a rope 12. The descender 10 comprises a first fixed flange 14 having a first spindle 15 for articulation of a mobile pulley 16 shaped as a cam 17, and a fixed spacer 18 for positioning and guiding of the rope, said spacer 18 being separated from the pulley 16 by a space 20 for passage of the rope. The pulley 16 is provided with a gorge 21 for winding of the rope 12.

The pulley 16 is mechanically linked to an operating mechanism 22 equipped with a pivoting manual actuating handle 24.

The upper part of the fixed spacer 18 is arranged as a fixed pad 26 having a braking surface 28 against which the rope 12 is pressed by the locking action of the cam 17.

The intermediate part of the spacer 18 extends externally along the righthand side (FIG. 2) of the first flange 14, and presents a curved internal sector 30, substantially centered on the spindle 15. The lower part of the spacer 18 comprises a cross-piece 32 extending horizontally between the two opposite side edges of the flange 14.

A second mobile flange 34 (FIGS. 1 and 3), having a similar shape to that of the first flange 14, is mounted rocking on a pivot 36 fixed to the first flange 14, and passing through the spacer 18 near the pad 26. The pivot 36 extends parallel to the first spindle 15 of the pulley 16, in a direction perpendicular to the first flange, such that the movement of the second flange 34 takes place in a plane parallel to the first flange 14 following manual action by the user between a closed position (FIGS. 1 and 3) in which the rope 12 is held captive in the space 20, and a separated position (not represented) enabling the rope 12 to be fitted in place or removed. The two flanges 14, 34 of the descender 10 are separated from one another by a transverse gap d, having a thickness corresponding to that of the spacer 18 and to that of the pulley 16.

Each flange 14, 34 comprises at its base a circular or oblong-shaped orifice 38, 40, designed for the passage of a karabiner (not represented) to attach the descender 10 to the user's harness. In the closed position of the second flange 34, the two orifices 38, 40 are aligned, and fitting the karabiner keeps the descender 10 closed preventing any inadvertent opening of the second flange 34.

A first return spring 42 (FIG. 2), notably of the torsion type, is arranged on the spindle 15 and biases the pulley 16 to an unlocking position when the tension on the rope 12 is lower than a preset threshold.

The clearance between the cam 17 and the braking surface 28 of the fixed pad 26 is then maximum. The upstream strand 12A of the rope 12 is hooked onto an anchoring device (not represented) fixed to the wall or rock above the descender 10, whereas the downstream strand 12B falls downwards due to the force of gravity. Inside the descender 10, the rope 12 is wound in an S-shape between the two opposite ends 44, 46 providing access to the space 20. The upstream strand 12A enters the space 20 via the bottom end 44, passes around the pulley 16 and exits via the top end 46 arranged near the braking surface 28 of the pad 26.

The mechanism 22 with the actuating handle 24 is located outside the gap d on the opposite side to the second flange 34, and bears on the rear external surface 47 of the first flange 14. The first spindle 15 of the pulley 16 passes through a hole 48 (FIG. 3) of the first flange 14, and also acts as pivoting part for a rotary base 50 to which base the handle 24 is securedly affixed. The base 50 is formed by an annular drum having an open end 52 on the same side as the rear surface 47 of the fixed flange 14. The base 50 and handle 24 assembly is constituted by a single part, made of metallic or insulating material, mounted with limited rotation on the first spindle 15.

The pulley 16 is equipped with a drive finger 54 passing through an oblong opening or aperture 56 of the first flange 14 to cooperate with a ramp 57 of a transmission lever 58, which lever is pivotally mounted on a second spindle 60 of the base 50 of the handle 24. According to the position of the handle 24, the ramp 57 can also slide along a fixed stop 62 securedly affixed to the first flange 14, causing pivoting of the transmission lever 58 from an active locking position with the drive finger 54 to an inactive unlocking position to release said finger 54. A second return spring 64, notably of the compression type, is arranged between a bearing face 66 of the rotary base 50 and the transmission lever 58, so as to bias said lever to the active position. The oblong opening 56 allowing movement of the drive finger 54 is formed by a sector corresponding to the angular movement of the pulley 16 between the locking and unlocking positions.

Figure 4:
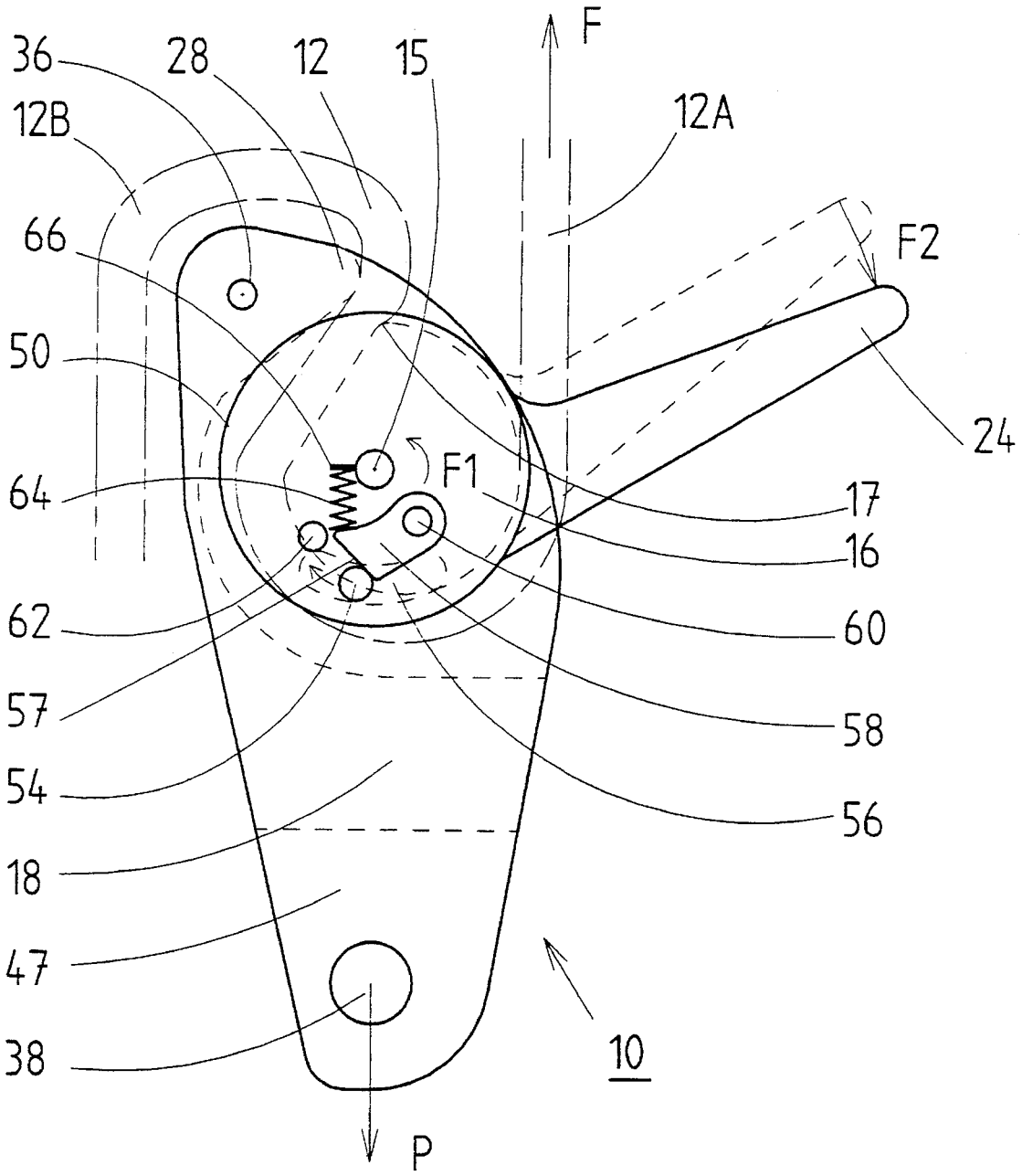
FIG. 4 represents the descender in the normal descent position following movement of the handle to the intermediate locking position.

The different phases of operation of the safety descender 10 are illustrated in FIGS. 4 to 7:

In the course of a descent along the rope 12, the weight P is applied to the lower part of the flanges 14, 34, and any voluntary or involuntary release of the handle 24 causes rotation of the pulley 16 in the direction of the arrow F1 by the reaction of the tension F on the rope. Locking of the rope 12 is then exerted against the braking surface 28 by the clamping action of the cam 17, and the handle 24 is urged to a raised position (broken line). To resume the descending movement, the handle 24 simply has to be lowered from the raised position in the direction of the arrow F2 (FIG. 4). The mechanical action of the ramp 57 of the transmission lever 58 on the drive finger 54 causes rotation of the pulley 16 in the opposite direction to the arrow F1 until maximum clearance of the cam 17 is achieved. Unlocking of the rope 12 enabling the descending movement to be continued takes place in an intermediate position of the handle 24, represented in unbroken lines in FIG. 4. During this first normal descent phase, the unidirectional mechanical link between the handle 24 and pulley 16 is permanent and is formed by the lever 58 comming into engagement with the finger 54, said lever 58 being held in the active locking position by the spring 64. Forced movement of the finger 54 to the left-hand end of the opening 56 by the unidirectional thrust action of the ramp 57 is performed from the raised position (in broken lines) to the intermediate position (in unbroken lines) of the handle 24 (FIG. 4).

Figure 5:
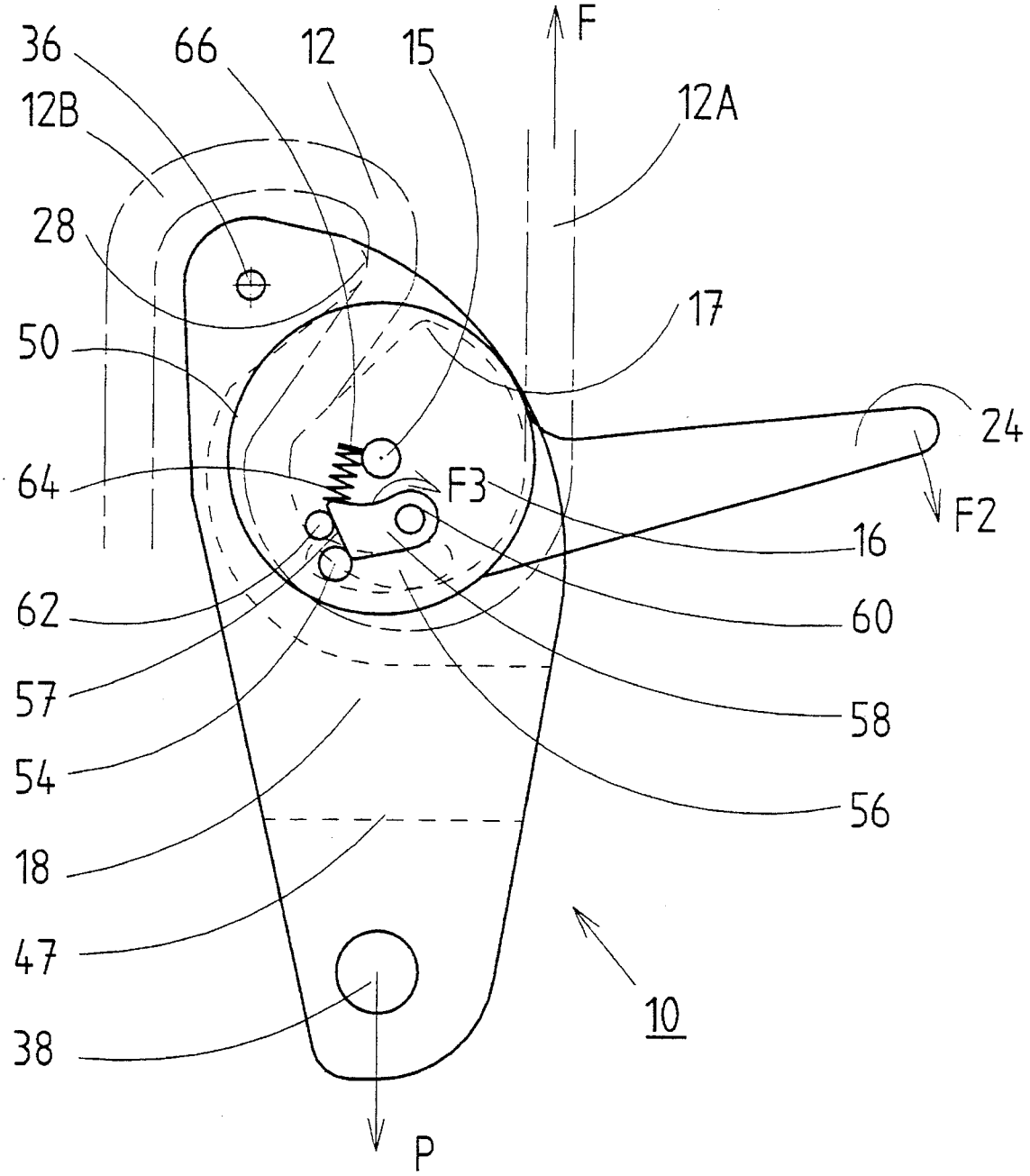
FIGS. 5 and 6 are identical views to FIG. 4 showing the evolution of the disengagement phase after the handle has been moved beyond the intermediate position.
Figure 6:
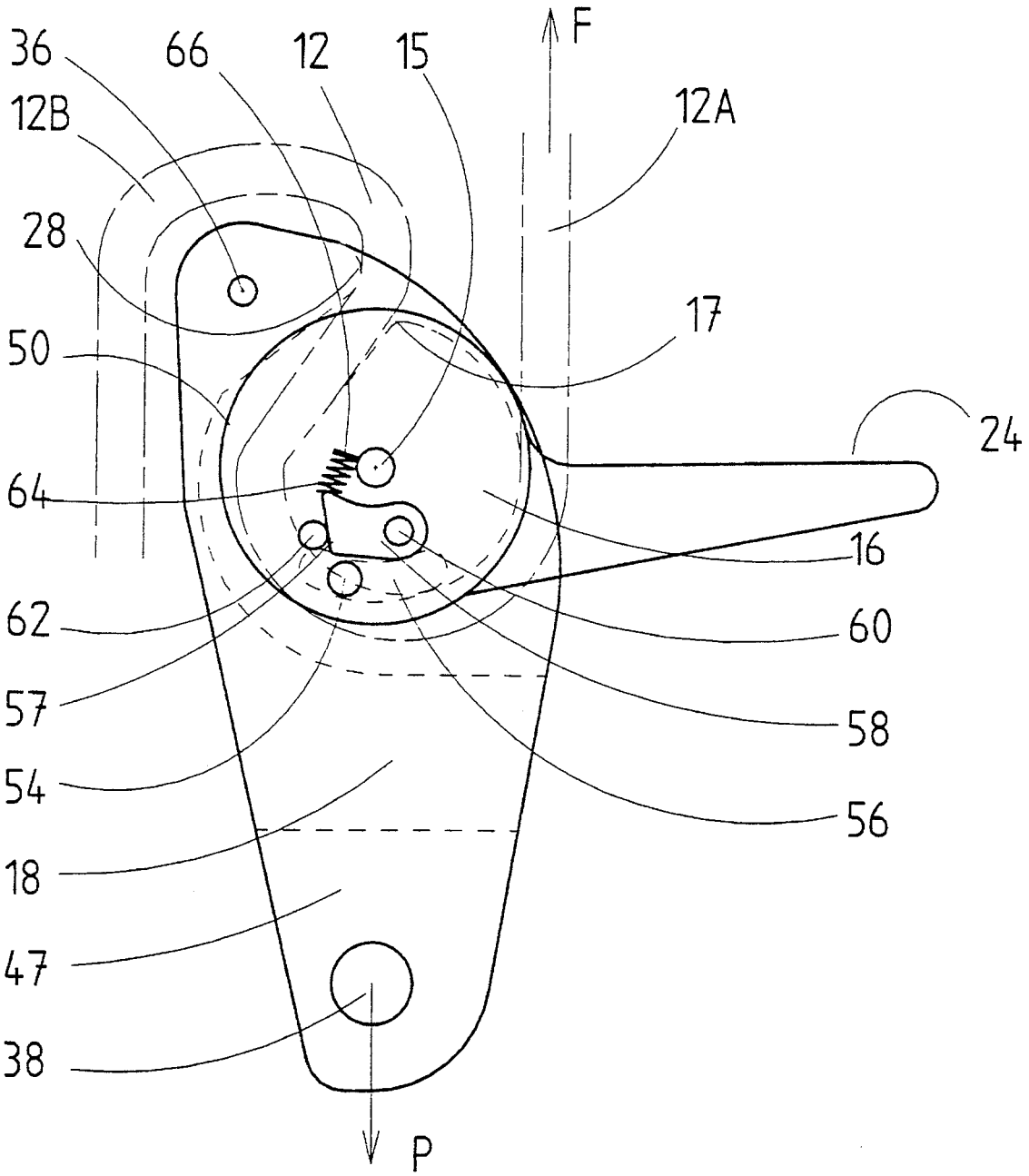

In FIG. 5, continued lowering of the handle 24 beyond the intermediate position of FIG. 4 results in continued sliding of the ramp 57 on the stop 62 of the flange 14. The transmission lever 58 rotates clockwise around the second spindle 60 (arrow F3) until the inactive unlocking position is reached (FIG. 6). In this position, breaking of the mechanical link between the handle 24 and pulley 16 takes place, and the drive finger 54, which is no longer subjected to the mechcanical action of the ramp 57, is released.

Figure 7:
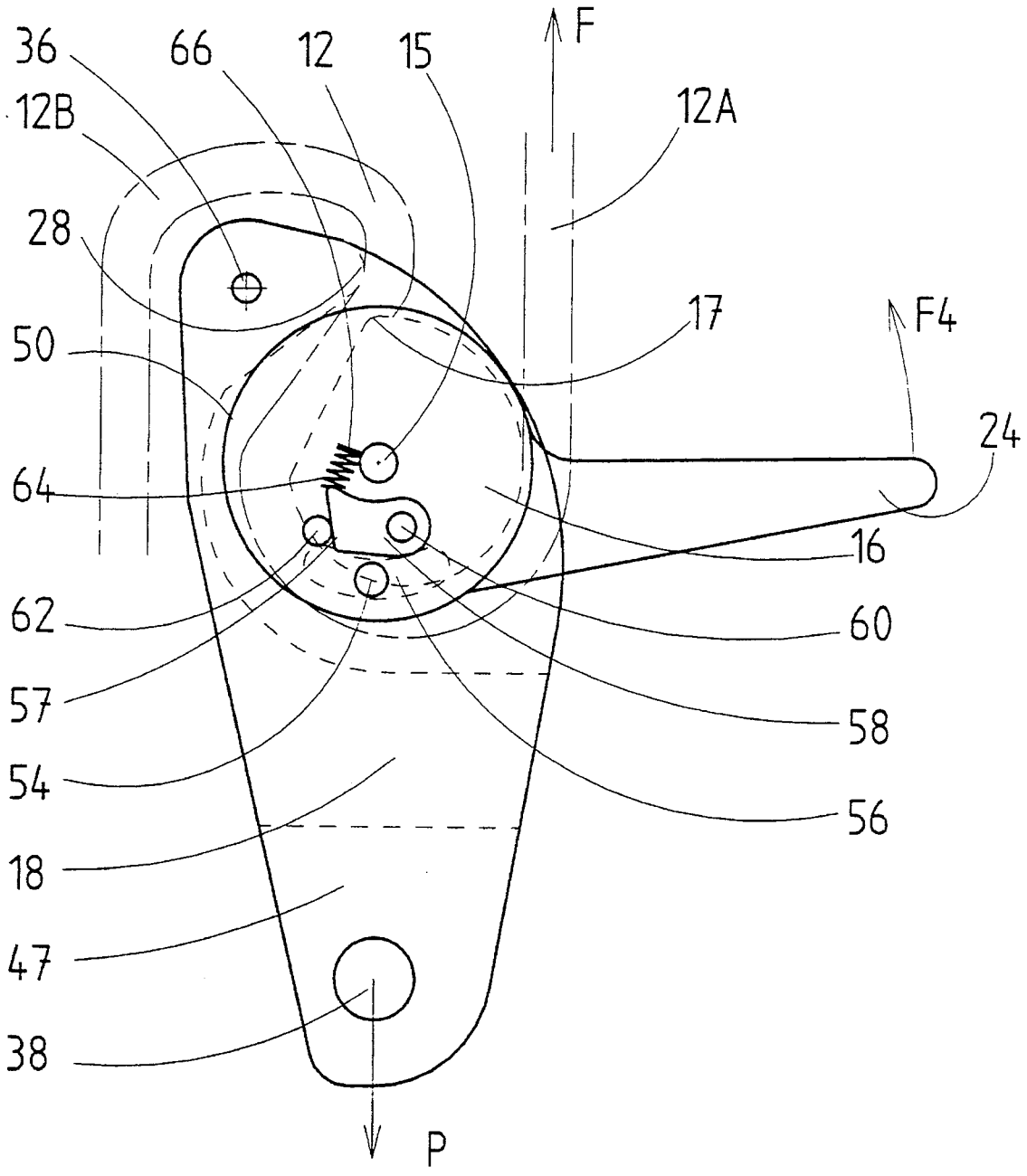
FIG. 7 shows the mechanism at the end of disengagement.
Figure 8:
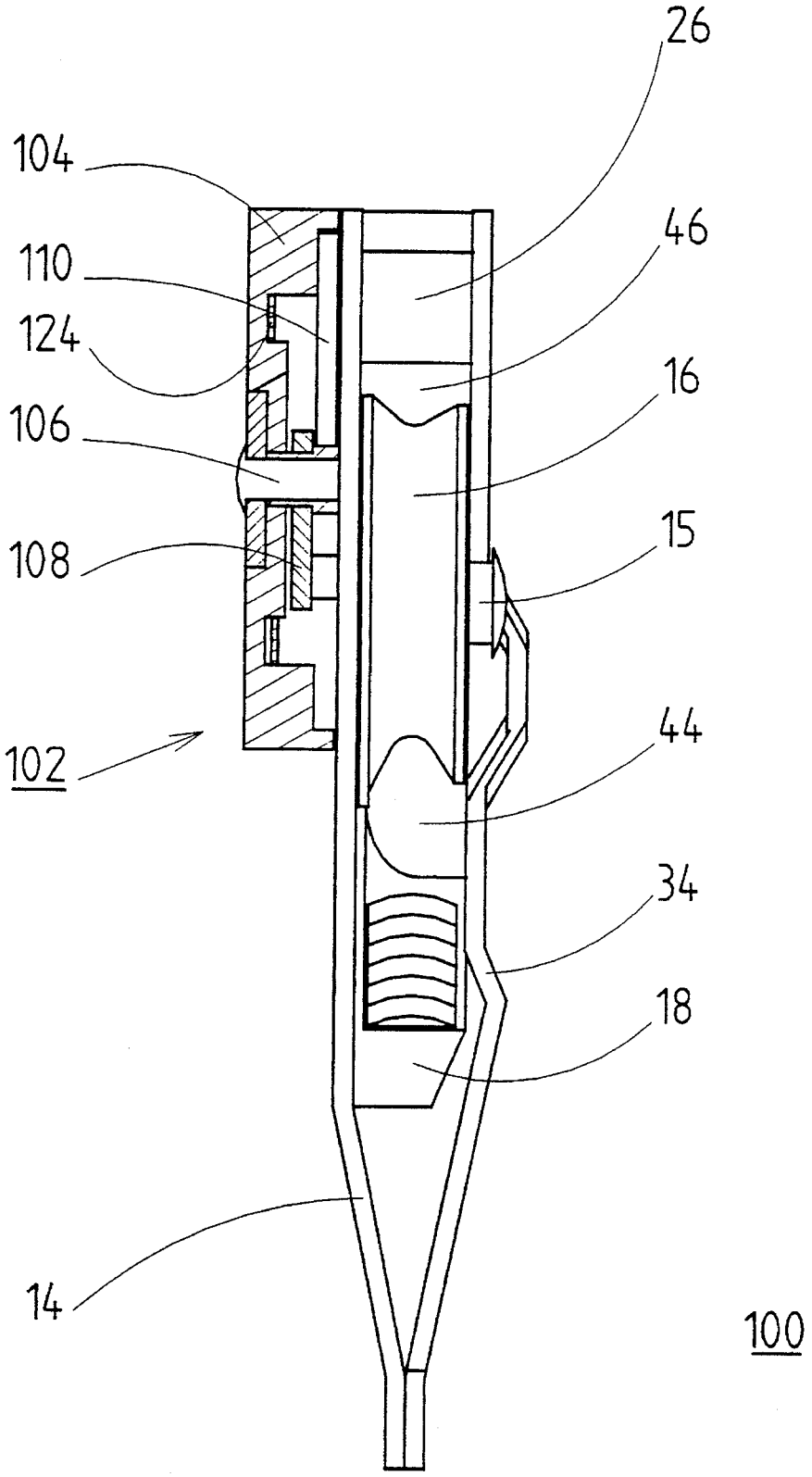
FIG. 8 is an identical view to FIG. 3 of an alternative embodiment.

Disengagement of the pulley 16 is then performed beyond the intermediate position of the handle 24. The tension F of the rope 12 drives the pulley 16 in rotation in the direction of the arrow F1, against the restoring force of the spring 42, and the cam 17 automatically clamps the rope against the braking surface 28 of the pad 26, followed by stopping of the descending movement (FIG. 7). During this locking travel by the cam 17, the drive finger 54 of the pulley 16 moves along the curved opening 56 towards the right-hand end. The mechanical link between the finger 54 and transmission lever 58 remains uninterrupted in the lowered position of the handle 24.

To reset the mechanism 22, the unidirectional mechanical link between the handle 24 and pulley 16 simply has to be re-established. Resetting is performed manually after the handle 24 has been raised in the direction of the arrow F4, from the lowered position (FIG. 7) to the raised position (FIG. 4). The ramp 57 leaves the stop 62 after counterclockwise rotation of the transmission lever 58, and the lever 58 returns to the active locking position in contact with the drive finger 54 of the pulley 16.

According to an alternative embodiment, resetting can also be performed in automatic manner by means of a return spring of the transmission lever 58, which automatically returns to the active locking position after disengagement and after the handle 24 has been released.

The double locking function of the rope 12 by the cam 17 takes place in the loaded state of the descender 10 for two distinct positions of the handle 24:

either a raised position after the handle 24 has been released;

or after disengagement of the mechanical link between the transmission lever 58 and the finger 54 of the pulley 16 when the handle 24 is lowered beyond the intermediate position.

The user who releases or grasps onto the handle 24 is in total safety due to this double locking system of the rope 12.

In the second embodiment of the descender 100 described in FIGS. 8 to 12, the same reference numbers will be used to designate identical or similar parts to those of the descender 10 of FIGS. 1 to 7. The arrangement of the descender 100 between the flanges 14, 34 is identical to that of the descender 10, but the operating mechanism 102 has different kinematics from those of the first mechanism 22.

The mechanism 102 comprises a cylindrical base 104 in the form of a drum associated to the handle 24, and mounted in rotation on a third spindle 106 fixed to the rear face of the first flange 14. The spindle 106 is offset with respect to the spindle 15 of the cam 17.

Inside the base 104 there is located a transmission rod 108 pivotally mounted on the third spindle 106 and cooperating with a drive finger 110 of the pulley 16. The finger 110 is formed by a lever of curved shape articulated on a fourth spindle 112 securedly affixed to the mobile pulley 16. The free end of the rod 108, opposite the third spindle 106, is provided with an operating pin 114 designed to come into engagement against the inside edge of the finger 110 to perform driving in rotation of the pulley 16 when the handle 24 is actuated. The rod 108 and finger 110 assembly forms a dead point passage toggle.

Figure 9:
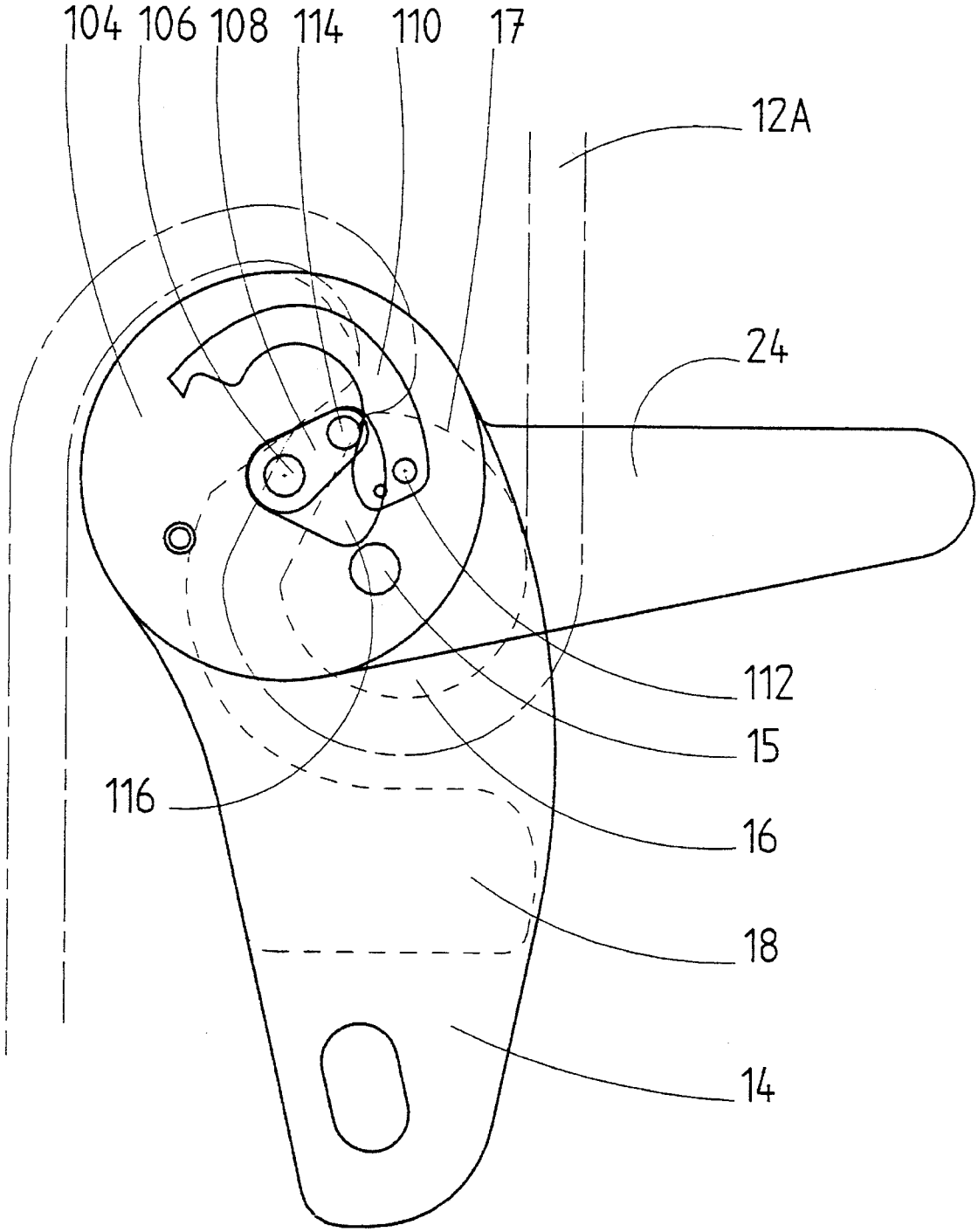
FIGS. 9 to 12 show identical views to FIGS. 4 to 7 with the different disengagement phases of the descender according to the embodiment of FIG. 8.

FIG. 9 shows the descender 100 in the normal descent state corresponding to the intermediate position of the handle 24. Movement of the handle 24 from the raised locking position of the rope to the intermediate unlocking position causes clockwise rotation of the rod 108, and the simultaneous thrust of the pin 114 on the finger 110. The cam 17 of the pulley 16 moves away from the pad 26 to enable the descending movement by sliding of the rope in the gorge of the pulley 16.

Figure 10:
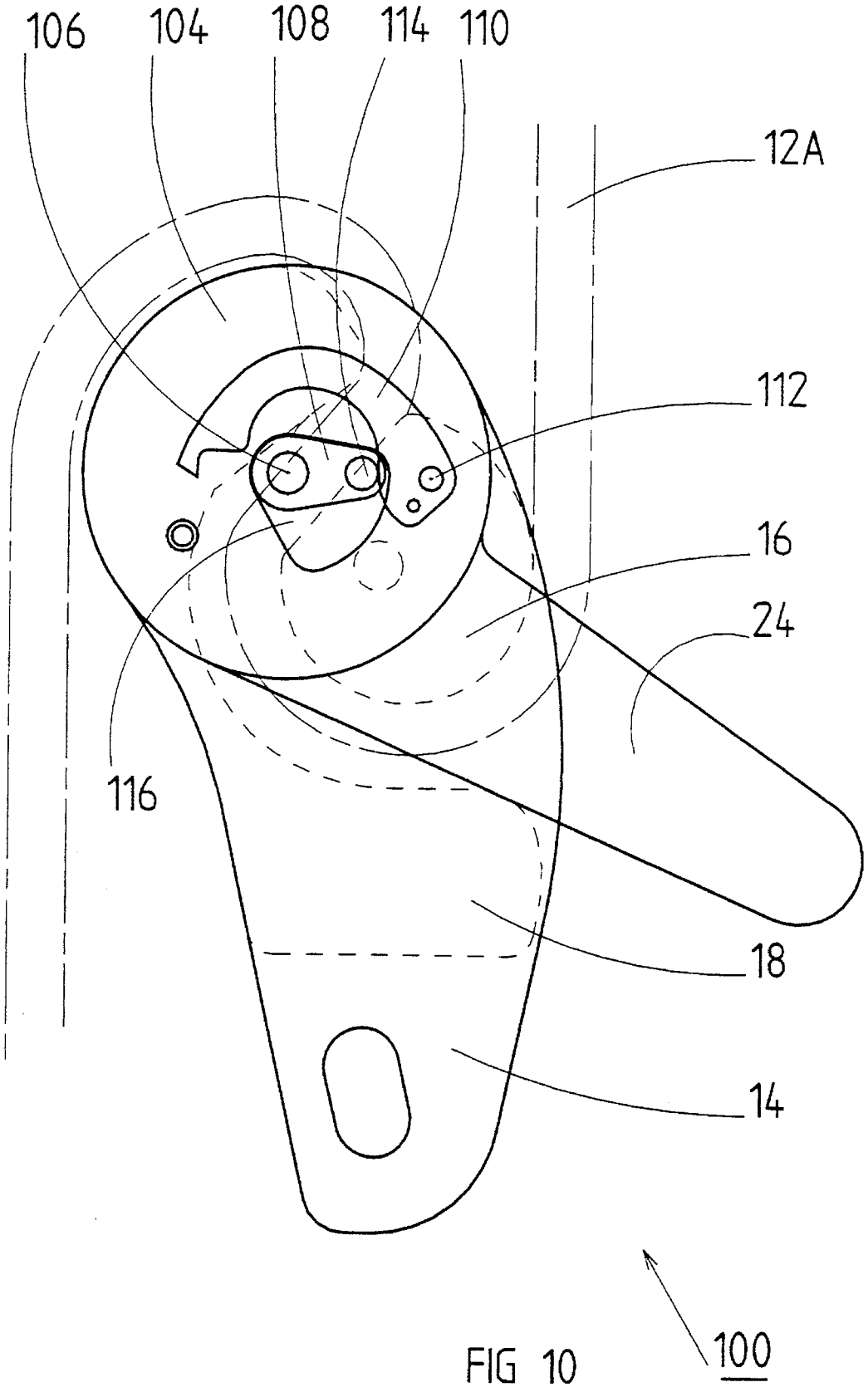

In FIG. 10, continued downwards movement of the handle 24 causes alignment of the transmission rod 108 with the fourth spindle 112 of the drive finger 110. The pin 114 of the rod 108 remains in contact with the convex part 115 of the finger 110, but this alignment position of the toggle is unstable.

Figure 11:
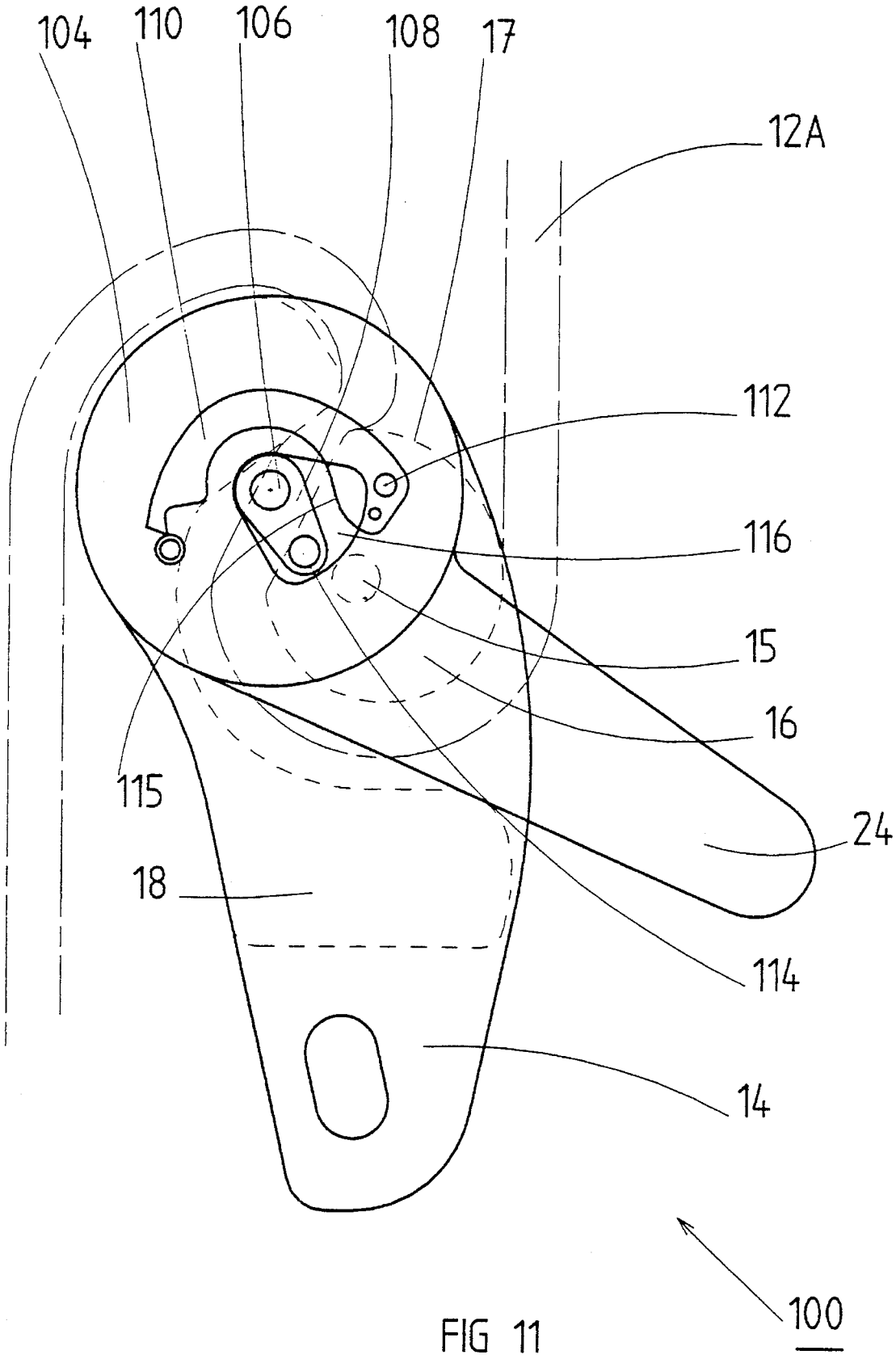
Figure 12:
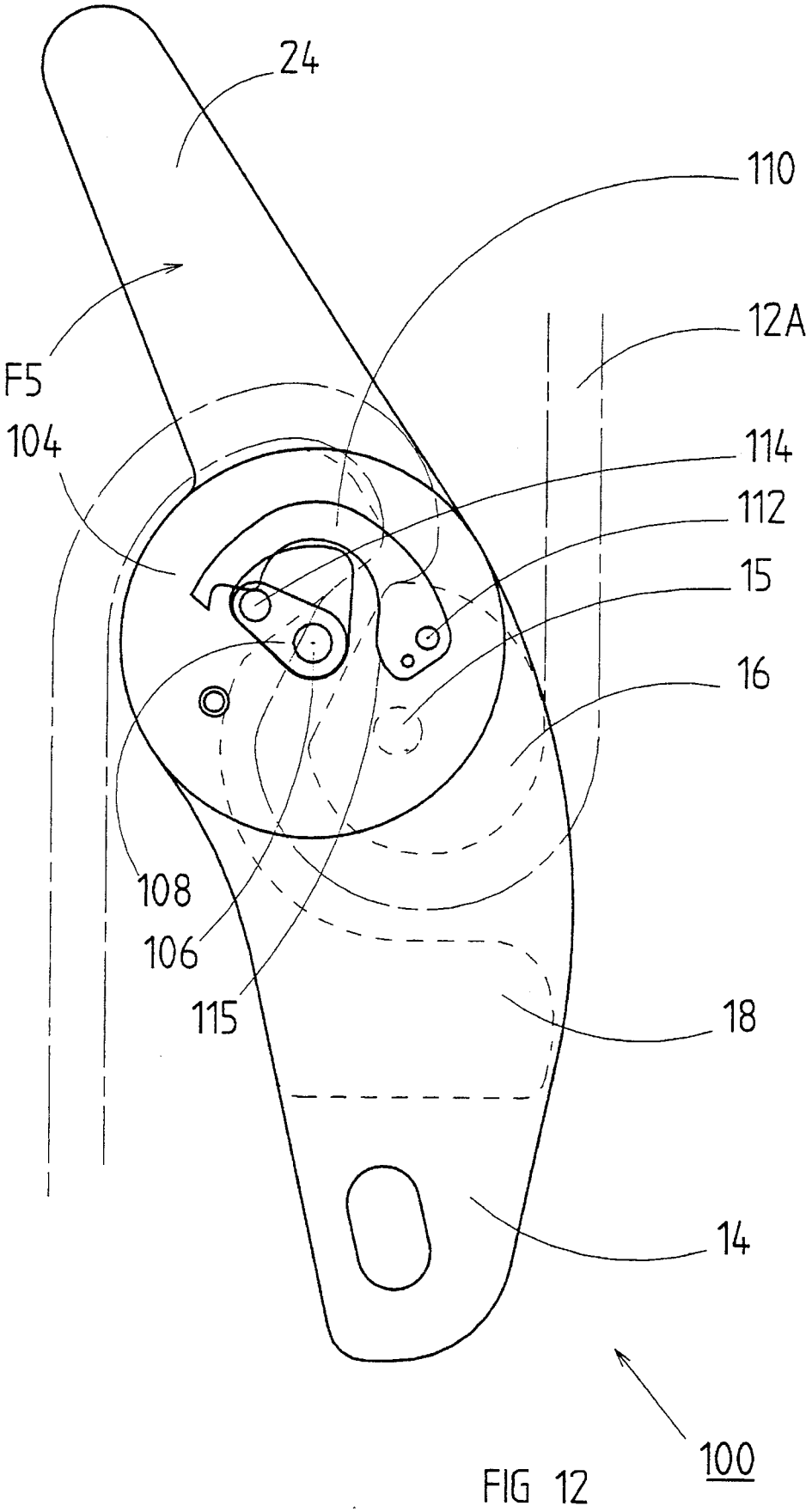

Overshooting the dead point of the toggle of the mechanism 102 takes place in FIG. 11 when continued lowering of the handle 24 is performed. The spindles 106, 112 are no longer aligned with the pin 114, which pin is released and escapes downwards due to the presence of the aperture 116 arranged in the base 50. The pin 114 escaping causes the drive finger 110 to be released and breaking of the mechanical link between the rod 108 and pulley 16. The friction of the rope on the pulley 16 urges the cam 17 counterclockwise to the locking position of the rope against the pad 26. After this unlocking phase of the descender 102, the user is stopped automatically in his descending movement.

To return to the normal descent state illustrated in FIG. 9, the handle 24 simply has to be turned three-quarters of a turn in the same direction F5 (see FIG. 12), until the pin 106 comes into contact with the convex part 115 of the drive finger 110. The toggle is reset and enables the pulley 16 to be rotated to unlock the rope following lowering of the handle 24. In the third embodiment of the descender 200 described in FIGS. 13 to 15, the same reference numbers will be used to designate identical parts, whereas the parts modified with respect to those of the previous descender 100 will be assigned a 2 as the hundreds digit instead of a 1.

The mechanism 202 is also of the toggle type, but the transmission device rod 208 is pivotally mounted on a fifth spindle 205 offset with respect to the third spindle 206 of the rotary base 204. The drive finger 210 is articulated on the pulley 16 at the level of the fourth spindle 212 moving along a sot 216 arranged in the flange 14, and comprises a curved bearing surface 213 in its intermediate part. This bearing surface 213 cooperates with the operating pin 214 of the rod 208, and enables the thrust action on the finger 210 to be increased to unlock the pulley 16 (see FIG. 13).

The rod 208 is associated to a return spring 209 which urges the rod up against the stop formed by the third spindle 206.

Figure 14:
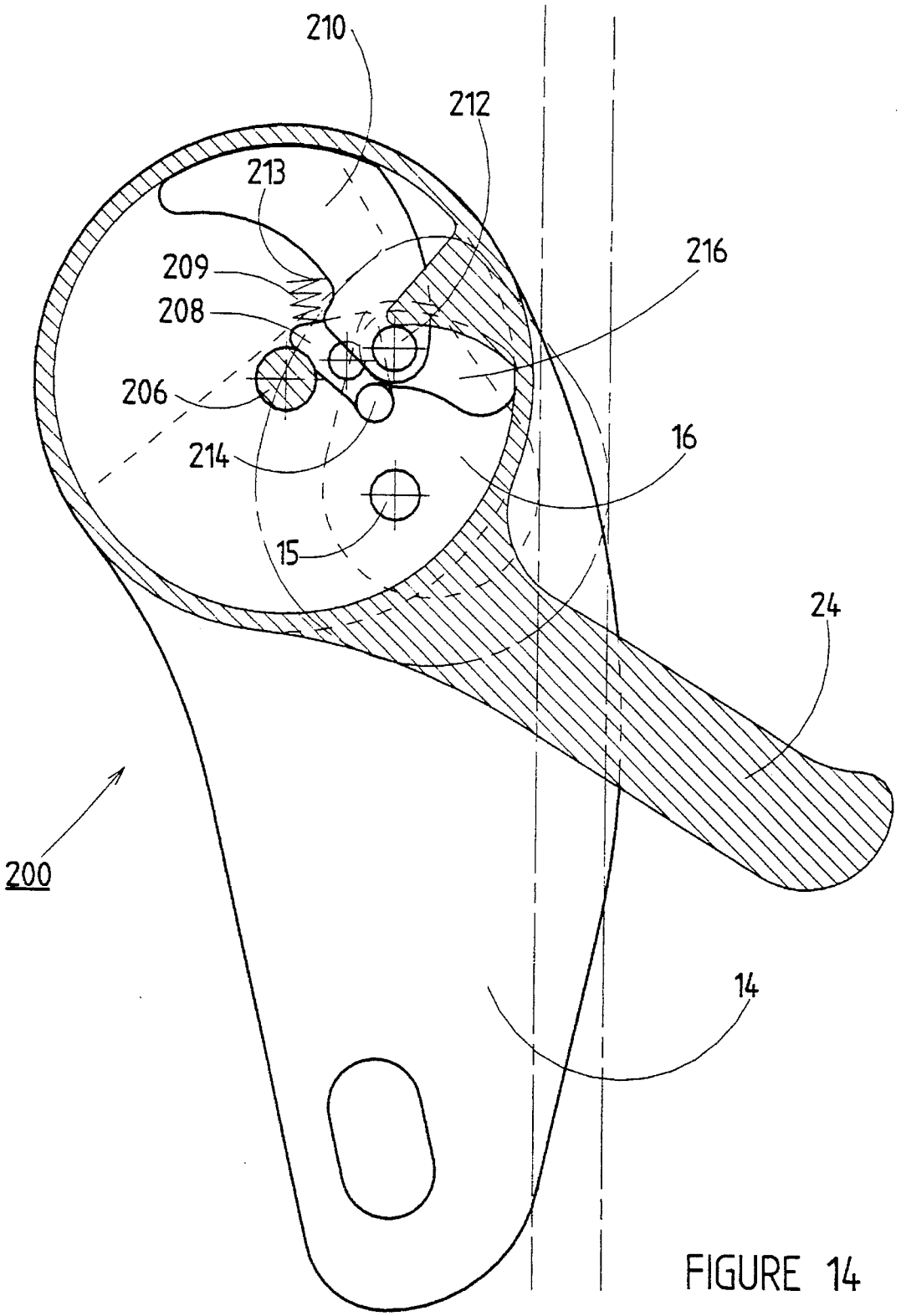

FIG. 14 shows the disengagement phase which is similar to that described previously in FIG. 11. After the dead point of the toggle has been passed, the pin 214 leaves the housing defined by the curved bearing surface 213, and causes breaking of the toggle and of the mechanical link between the rod 208 and pulley 16.

Figure 13:
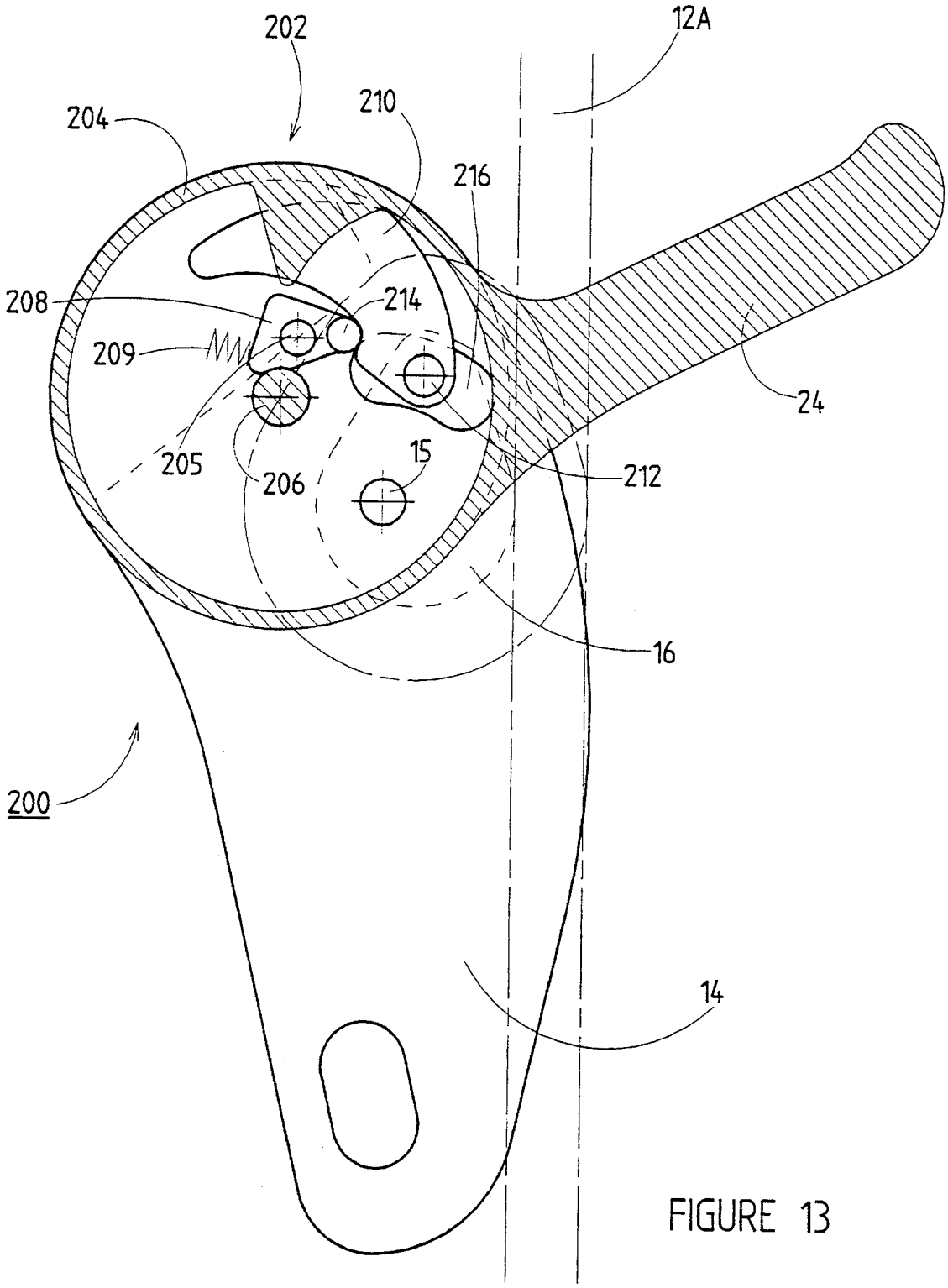
FIGS. 13 to 15 show identical views to FIGS. 9 to 12 of another alternative embodiment.
Figure 15:
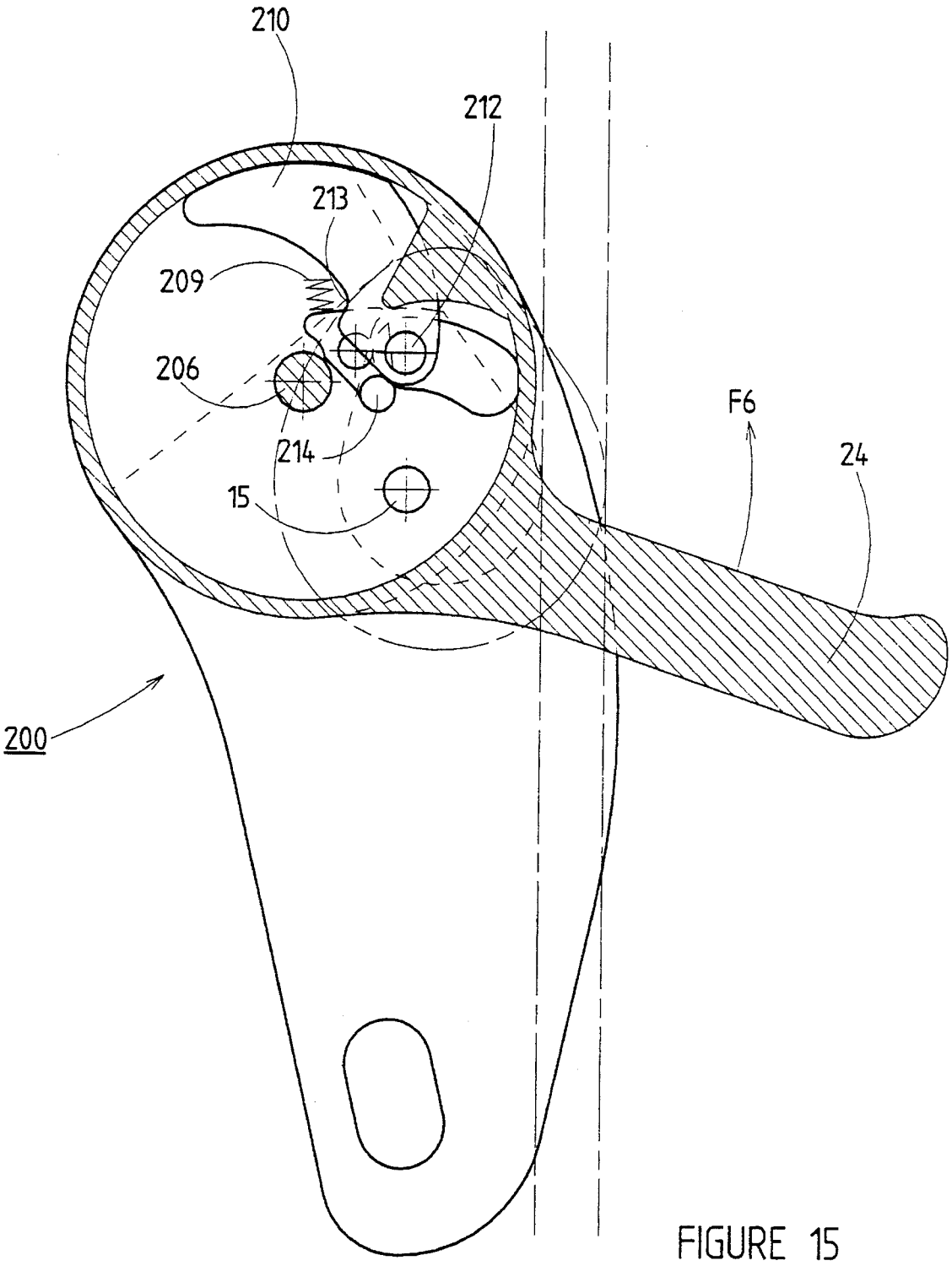

The toggle mechanism 202 can be reset by reversing the direction of operation of the handle 24 (arrow F6, FIG. 15) from the disengaged position to the intermediate position, in which the pin 214 of the rod 208 passes the hangup point of the finger 210 and houses itself in the recess of the bearing surface 213. The rotary resetting movement of the mechanism 202 of FIGS. 13 to 15 is opposed to that of the descender 100 illustrated in FIG. 12.

We claim:

1. A self-locking safety descender for descending along a rope, comprising:

a first fixed flange supporting a braking pad and a mobile pulley in the form of a cam, said cam being mounted with limited rotation on a first articulation spindle between a locking position and an unlocking position, and separated from the pad by a space for passage of the rope, a second retractable flange separated from the first flange by a transverse gap, and able to occupy a withdrawn position for fitting or removal of the rope, and a closed position, in which the rope is held captive in the space, an actuating handle of the pulley to perform manual unlocking of the rope, and a first spring to return the pulley to the unlocking position when the tension of the rope is lower than a preset threshold, wherein the cam is associated to a drive finger cooperating with a mechanism having a transmission part movable between an active engagement position with the finger to establish a unidirectional mechanical link between the handle and the pulley when the handle is actuated to an intermediate unlocking position in the course of the descending movement, and an inactive escape position to break said mechanical link after said intermediate position of the handle has been passed, causing disengagement of the pulley and automatic return of the cam to the locking position due to the action of the tension of the rope.

2. The descender according to claim 1, wherein the mechanism is located outside the gap between the two flanges, and the drive finger of the pulley comprises a part passing through an opening of the first flange.

3. The descender according to claim 1, wherein the drive finger and transmission part are housed inside a rotary base in the form of an annular drum with an open base adjoined to the first flange, the handle protruding out from said base.

4. The descender according to claim 3, wherein the transmission part is formed by a lever pivotally mounted on a second spindle securedly affixed to the base, and comprising a ramp cooperating with a cylindrical part of the finger movable in the opening, said opening being shaped as a circular sector centered on the first spindle, and having a length corresponding to the angular movement of the pulley between the locking and unlocking positions.

5. The descender according to claim 4, wherein the ramp of the transmission lever cooperates with stop means after passing the intermediate position of the handle, resulting in pivoting of said lever to the inactive unlocking position for disengagement of the pulley.

6. The descender according to claim 4, wherein a second return spring is disposed between a bearing face of the base and the transmission lever to bias the latter to the active locking position, in which the ramp is bearing against the drive finger.

7. The descender according to claim 4, wherein the rotary base is mounted on an aligned extension of the first spindle passing perpendicularly through the first flange, and the stop means are formed by a fixed pin securedly affixed to the first flange and extending parallel to the second spindle of the transmission lever.

8. The descender according to claim 1, wherein the transmission part is formed by a rod cooperating with the drive finger to form a toggle with a dead point near to said intermediate position of the handle.

9. The descender according to claim 8, wherein the base of the handle is mounted with rotation on a third spindle securedly affixed to the first flange, and the transmission rod comprises an operating pin, designed to come into engagement with a curved bearing surface of the drive finger, which finger is articulated on a fourth spindle securedly affixed to the pulley.

10. The descender according to claim 1, wherein the mechanism is equipped with resetting means causing the transmission part to return to the active position to re-establish the mechanical link between the handle and pulley.

11. The descender according to claim 10, wherein the resetting means are activated by a manual actuation movement of the handle resulting in the transmission part coming into engagement in the active position with the drive finger.

12. The descender according to claim 10, wherein the resetting means are arranged to cause an automatic return to an active position after the disengaged handle has been released.

* * * * *